US008659227B2

(12) United States Patent
Mulcahy et al.

(10) Patent No.: US 8,659,227 B2
(45) Date of Patent: Feb. 25, 2014

(54) MAGNETRON

(75) Inventors: Bernard Richard Mulcahy, Chelmsford (GB); Martin Bernard Edwards, Chelmsford (GB)

(73) Assignee: E2V Technologies (UK) Limited, Essex (GB)

( * ) Notice: Subject to any disclaimer, the term of this patent is extended or adjusted under 35 U.S.C. 154(b) by 413 days.

(21) Appl. No.: 13/077,031

(22) Filed: Mar. 31, 2011

(65) Prior Publication Data

US 2011/0241543 A1 Oct. 6, 2011

(30) Foreign Application Priority Data

Mar. 31, 2010 (GB) ..... 1005412.0

(51) Int. Cl.
*H01J 25/50* (2006.01)

(52) U.S. Cl.
USPC ..... 315/39.71; 315/51; 315/61; 315/71

(58) Field of Classification Search
USPC ..... 315/39.51–39.77, 326, 111.59; 313/153
See application file for complete search history.

(56) References Cited

U.S. PATENT DOCUMENTS 3,899,715 A * 8/1975 Esteron et al. ..... 315/39.61
3,904,919 A * 9/1975 Farney et al. ..... 315/39.61
3,914,644 A * 10/1975 Gerard ..... 315/39.61
4,338,545 A 7/1982 Koinuma et al.
8,237,608 B2 * 8/2012 Takashima ..... 342/175
8,264,150 B2 * 9/2012 Leonhardt ..... 315/39.51
8,390,201 B2 * 3/2013 Yasuda et al. ..... 315/39.71

FOREIGN PATENT DOCUMENTS

GB 476567 A 12/1937
GB 826822 1/1960
JP 09120781 A 5/1997

OTHER PUBLICATIONS

International Property Office Search Report for GB 1105040.8 Dated June 28, 2011.

* cited by examiner

*Primary Examiner* — Daniel Cavallari
*Assistant Examiner* — Srinivas Sathiraju
(74) *Attorney, Agent, or Firm* — Venable LLP; Robert Kinberg

(57) ABSTRACT

A magnetron includes an anode with an anode casing at least partly surrounding the anode. A pair of permanent magnets on each side of the anode define an interaction region and create a magnetic circuit defining a magnetic field through the interaction region. A mass of magnetically permeable material is positioned in a vicinity of the magnetic circuit. The mass is arranged to be slidable over the anode casing. A locking device secures the position of the mass to set the strength of the magnetic field through the interaction region.

10 Claims, 2 Drawing Sheets

MAGNETRON

CROSS-REFERENCE TO RELATED APPLICATIONS

Priority is claim with respect to Great Britain application No. GB 1005412.0 filed Mar. 31, 2010, the disclosure of which is incorporated herein by reference in its entirety.

BACKGROUND

This invention relates to magnetrons.

Magnetrons typically use permanent magnets to set up a magnetic field through the interaction region. AlNiCo is often used as the magnetic material and is relatively easy to magnetise. As a result, it is found convenient to buy the material in a demagnetised state and to magnetise it in the finished magnetron. It is even possible to make fine adjustments to the magnetic field strength by controlled degaussing of the magnet using an alternating magnetic field generated by coils carrying an a.c. current.

Use of high energy magnetic materials such as samarium-cobalt or neodymium-iron-boron enables much smaller and lighter magnetrons to be realised but such magnetic material is much more difficult to magnetise and it is generally necessary to magnetise the material during manufacture, meaning that the magnets are bought in a fully magnetised state.

However, it may sometimes be necessary to trim the magnetic field in order that the magnetron will operate at the desired operating point of current and voltage.

Some existing methods of adjusting the magnetic field strength existing in a magnetron are described with reference to FIG. 1, which is a perspective view of a part of a known magnetron arrangement.

A magnetron is an evacuated device comprising a plurality of resonant cavities surrounding an interaction region where electrons emitted from a hot cathode are subjected to the combined effects of crossed electric and magnetic fields. The magnetic field is often focussed across the interaction region by means of high permeability pole-pieces, which sometimes form part of the vacuum envelope. Detail of the magnetron is omitted from FIG. 1 but the interaction region is positioned between pole pieces 1, 2 of a permanent magnet.

The magnetic field can be generated by a horseshoe magnet or by a pair of magnets with a magnetically permeable return path. The field can be applied directly without pole pieces but more commonly the field is concentrated by means of high permeability pole-pieces. The pole pieces may be in intimate contact with the magnet(s) or they may connect via an intermediate pole-shoe for convenience in construction. FIG. 1 shows an example where the field is provided by magnet blocks 3, 4 of one polarity and magnet blocks 5, 6 of the opposite polarity. The blocks 7, 8 are pole shoes for housing the respective pole pieces 1, 2. Additional pairs of magnet blocks on the far side of pole shoes 7, 8 symmetrical with the magnetic blocks 3-6 may also be provided. Thin sheets of mild steel 9, 10 provide the magnetic return path.

One known method of adjusting the strength of the magnetic field through the magnetron is by the use of corner shunts, such as that illustrated by the reference numerals 11, 12. These corner shunts are of mild steel, and some of the magnetic flux is diverted through them. This reduces the magnetic field available to extend through the magnetron itself. They can be used where it is desired to reduce the magnetic field strength in the working gap between the pole pieces 1, 2.

Alternatively, flat shunts, consisting of one arm only of the illustrated corner shunts, may be employed to reduce the magnetic field in the working gap.

Another known method of achieving this objective is to provide additional sheets of thin mild steel for the magnetic return path.

It has been proposed (U.S. Pat. No. 4,338,545) to adjust the magnetic field in the interaction space to compensate for changes in field strength resulting from temperature variation by automatic displacement of auxiliary pole pieces in response to deformation of a bimetallic member.

It has also been proposed (UK Patent No. 826 822) to displace a magnetic shunt between the pole pieces and pole shoes of a magnetron in a radial direction towards the axis of the anode in order to considerably reduce the magnetic forces to assist in the magnetron being assembled/disassembled.

SUMMARY

In one embodiment of the invention there is provided a magnetron, comprising: an anode; an anode casing at least partly surrounding the anode; a pair of permanent magnets on each side of the anode defining an interaction region and creating a magnetic circuit defining a magnetic field through the interaction region; a mass of magnetically permeable material positioned in a vicinity of the magnetic circuit, the mass being arranged to be slidable over the anode casing; and a locking device to secure the position of the mass to set the strength of the magnetic field through the interaction region.

It is possible with the arrangement to make fine adjustments to the field strength through the interaction region.

The mass may be a slider movable in the direction of a tangent to the anode casing, and may be securable with a bolt, with optional serrations to assist the clamping of the slider. The slider may be slidable on a guide mounted on an output waveguide from the magnetron, and may include a channel-shaped region in engagement with the guide.

The anode casing over which the mass is slidable may be the exterior of the anode body, or the exterior of an additional casing at least partly surrounding the anode body.

Alternatively, the magnetically permeable member may be a rotary member.

BRIEF DESCRIPTION OF THE DRAWINGS

Ways of carrying out the invention will now be described in detail, by way of example, with reference to the accompanying drawings, in which.

Like reference numerals have been used for like parts throughout all the drawings.

DETAILED DESCRIPTION

Figure 1:
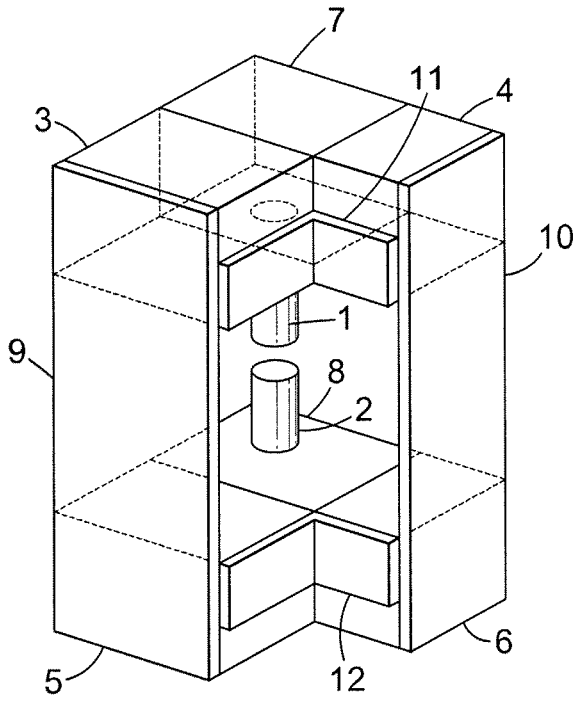
PRIOR ART Fig. 1
FIG. 1 is a perspective view to illustrate known methods of adjusting the magnetic field strength in a magnetron.
Figure 2:
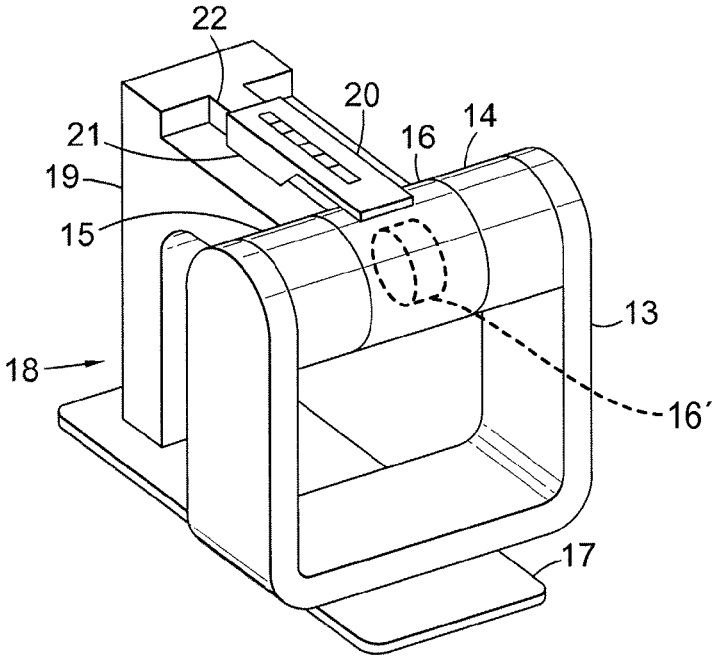
FIG. 2 is a perspective view of a magnetron according to the invention.

Referring to FIG. 2, a magnetically-permeable yoke 13 carries permanent magnets 14, 15, between which the magnetron anode is positioned, the anode body 16' being surrounded by an outer casing 16. The magnets are fully magnetised, and may be samarium-cobalt or neodymium-iron-boron. The yoke is mounted on a baseplate 17 of a non-magnetic material which might be a casting indicated generally by the reference numeral 18. The casting includes a coupler and waveguide portion 19, which leads microwave energy generated in the magnetron to an output flange in the baseplate.

The magnetic field strength through the interaction region of the magnetron is adjustable by means of a slider 20 of mild steel. The slider is constrained to travel in an axial direction only, because the rear portion 21 is channel-shaped and slides over a rib 22 of the casting 18. The upper surface of the rib has side-to-side serrations, as has the mating face of the channel-shaped region, and the rib is locked in a desired position by tightening a bolt (not shown) which extends through an aperture in the slot in the upper surface of the channel into a threaded hole in the face of the rib.

The track can be marked with gradations as a setting aid for the operator.

Figure 3:
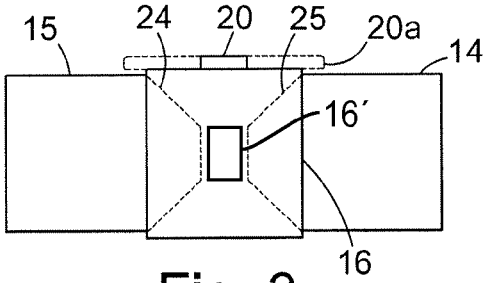
FIG. 3 is a front view of part of the magnetron shown in FIG. 2.

Referring to FIG. 3, which is a front view of the region between the arms of the yoke, and shows the hidden tapering pole shoes 24, 25 of the magnetron in dotted lines, the tip of the slider 20 extends between the upper peripheries of the magnets 14, 15. Part of the magnetic flux circulating between the pole pieces and the yoke is diverted through the tip, with the result that the magnetic field strength between the pole shoes 24, 25 is reduced. The amount by which it is reduced may be varied by moving the slider forwards and backwards.

When a desired field strength through the magnetron has been achieved, the bolt is tightened.

Variations may of course be made without departing from the scope of the invention. Thus, in order to provide greater adjustment the slider may be wider, such as the alternative version 20*a* shown in dotted lines in FIG. 3. The cylindrical diameter of the anode outer casing 16 is slightly greater than that of the magnets 14, 15, so that the alternative version 20*a* of the slider is slightly spaced from the magnets. Different spacings are possible, or the alternative version 20*a* could actually be in contact with the magnets. Equally, there could be a slight spacing between the slider and the outer casing 16 in the case of sliders 20 or 20*a*.

For finer adjustment, the tip of the slider may be triangular, or profiled in some other way.

Figure 4:
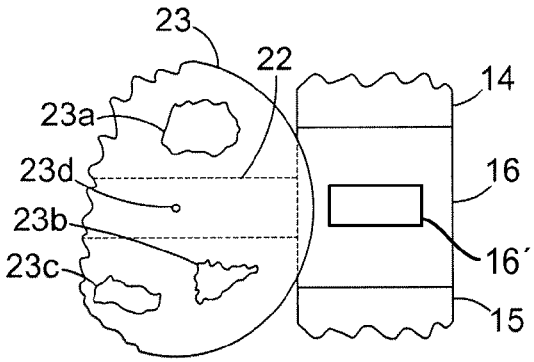
FIG. 4 is a fragmentary top plan view of a possible modification to the embodiment of FIG. 2.

As a further alternative, shown in fragmentary form in FIG. 4, the adjuster may be in circular form with a lobed profile that can be rotated before being fixed in order to vary in a controlled way the amount of flux diverted away from the magnetron interaction space. The adjuster is a circular disc 23, shown cut-away, which may be made of a non-magnetic material such as a plastics material, with magnetically permeable inserts 23*a*, 23*b*, 23*c*, and the disc may be locked by a bolt (not shown) tightened up on its axis of rotation 23*d*. The disc 23 could be mounted on rib 22, partially overlapping the magnetron 16 and magnets 14, 15 (the latter being shown cut-away).

As a further alternative, the rotary adjuster could be of uniform magnetic permeability, but non-circular, that is, eccentric-shaped.

It will be understood that the above description of the present invention is susceptible to various modifications, changes and adaptations, and the same are intended to be comprehended within the meaning and range of equivalents of the appended claims.

The invention claimed is:

1. A magnetron, comprising:

an anode;

an anode casing at least partly surrounding the anode;

a pair of permanent magnets on each side of the anode defining an interaction region and creating a magnetic circuit defining a magnetic field through the interaction region;

a mass of magnetically permeable material positioned in a vicinity of the magnetic circuit, the mass being arranged to be slidable over the anode casing; and a locking device to secure the position of the mass to set the strength of the magnetic field through the interaction region.

2. A magnetron as claimed in claim 1, wherein the mass comprises a slider movable in a direction tangentially to the anode casing.

3. A magnetron as claimed in claim 2, wherein the locking device comprises a bolt to enable the slider to be locked into position.

4. A magnetron as claimed in claim 2, further including a surface with serrations operatively arranged with the slider to assist in clamping of the slider.

5. A magnetron as claimed in claim 2, further including an output waveguide and a guide mounted on the output waveguide, wherein the slider is slidable on the guide.

6. A magnetron as claimed in claim 5, wherein the slider includes a channel-shaped region in engagement with the guide.

7. A magnetron as claimed in claim 1, wherein the mass comprises a rotary member.

8. A magnetron as claimed in claim 7, wherein the rotary member has a magnetic permeability that is non-uniform in a circumferential direction.

9. A magnetron as claimed in claim 1, wherein the permanent magnets comprise alloys including at least one of samarium, neodymium or other rare earth metals.

10. A magnetron as claimed in claim 9, wherein the permanent magnets comprise allows of samarium-cobalt or neodymium-iron-boron.

* * * * *